United States Patent [19]

Thorburn

[11] Patent Number: 4,782,675

[45] Date of Patent: Nov. 8, 1988

[54] LOCK ASSEMBLY

[76] Inventor: Maxwell Thorburn, P.O. Box 707, Clear Lake Oaks, Calif. 95423

[21] Appl. No.: 94,657

[22] Filed: Sep. 9, 1987

[51] Int. Cl.[4] ..... E05B 65/06

[52] U.S. Cl. ..... 70/129; 70/DIG. 63; 70/DIG. 80; 292/148; 292/150

[58] Field of Search ..... 70/129, DIG. 63, 134, 70/92, 104, 124, 465, DIG. 80; 292/148, 150

[56] References Cited

U.S. PATENT DOCUMENTS

| | | | |
|---|---|---|---|
| 1,260,469 | 3/1918 | Smith | 292/148 X |
| 1,806,031 | 5/1931 | Vignos | 70/DIG. 63 X |
| 3,027,744 | 4/1962 | Moore | 70/134 |
| 3,154,938 | 11/1964 | Cohen | 70/134 |
| 3,988,031 | 10/1976 | Meyer | 70/DIG. 63 X |
| 4,229,956 | 10/1980 | Thorburn | 70/DIG. 63 X |
| 4,648,638 | 3/1987 | McKnight | 292/150 X |
| 4,673,202 | 6/1987 | Willis | 292/150 X |

*Primary Examiner*—Lloyd A. Gall
*Attorney, Agent, or Firm*—Flehr, Hohbach, Test, Albritton & Herbert

[57] ABSTRACT

Lock assembly particularly suitable for use on rental storage spaces and the like. The assembly includes a lock bolt which is movable between extended and retracted positions and a slide plate which can move with the bolt. The slide plate is normally locked in a fixed position by a lock which is controlled by the owner of the rental space. The renter can lock the bolt to the slide plate to secure the space. The owner-controlled lock permits the owner to release the slide plate and retract that plate along with the bolt to gain access to the space with the renter's padlock in place. This lock also permits the owner to lock the bolt in the extended position so that the renter will no longer have access to the space even though he may remove his padlock.

8 Claims, 3 Drawing Sheets

LOCK ASSEMBLY

BACKGROUND OF THE INVENTION

A. Field of the Invention

This invention pertains generally to locks, and more particularly to a lock assembly which is particularly suitable for use on rental storage spaces and the like.

B. Description of the Prior Art

In a space, rental storage it is desirable for the renter to have normal access to the space but for the owner to retain control over it. The renter is typically allowed to install his own padlock to which only he has a key. At times, however, it may be necessary for the owner to remove the padlock in order to get access to the space, for example in the case of an emergency. At other times, it may be necessary for the owner to lock the renter out of the space, for example in the event of a failure to pay rent.

U.S. Pat. No. 4,229,956 describes a lock mechanism which allows the owner to enter the space and to lock the renter out without disturbing a padlock installed by the renter. This mechanism has a hasp affixed to an axially extendable, rotatable bolt and a staple carried by a plate which can slide with the bolt. The slide plate is normally held in a fixed position by a second lock which is controlled by the operator. The renter can normally secure the space by locking the bolt to the slide plate with his own padlock which secures the hasp and the staple together in the normal manner. The owner can gain access to the space with the padlock in place by unlocking the second lock to release the slide plate and moving the slide plate and the bolt as a unit to retract the bolt. The mechanism also has a pin accessible from the back side of the door which the owner can engage to lock the bolt and the slide plate together independently of the renter's padlock. When the first owner-controlled lock is reengaged to lock the slide plate in place, the renter is locked out of the space even though he may remove his padlock. This mechanism represents a significant improvement over prior systems in which the renter's padlock had to be cut or otherwise broken to give the owner access to the space, and another padlock had to be installed in order to resecure the space or to lock the renter out of it.

OBJECTS AND SUMMARY OF THE INVENTION

It is in general an object of the invention to provide a new and improved lock assembly of the type which allows one person to have normal access to a space and a second person to enter the space and to lock the first person out of it.

Another object of the invention is to provide a lock assembly of the above character which overcomes the limitations and disadvantages of lock mechanisms heretofore provided for this purpose.

These and other objects are achieved in accordance with the invention by providing a lock assembly having a bolt movable between extended and retracted positions, a slide movable with the bolt, first lock means for securing the bolt to the slide when engaged, and second lock means movable between a first position in which the slide is held in a fixed position and the bolt is free to move between the extended and retracted positions unless the first lock means is engaged, a second position in which the slide is free to move and the bolt can be moved between the extended and retracted positions even if the first lock means is engaged, and a third position in which the bolt is locked in the extended position and cannot be moved to the retracted position even if the first lock means is disengaged.

DESCRIPTION OF THE PREFERRED EMBODIMENT

Figure 1:
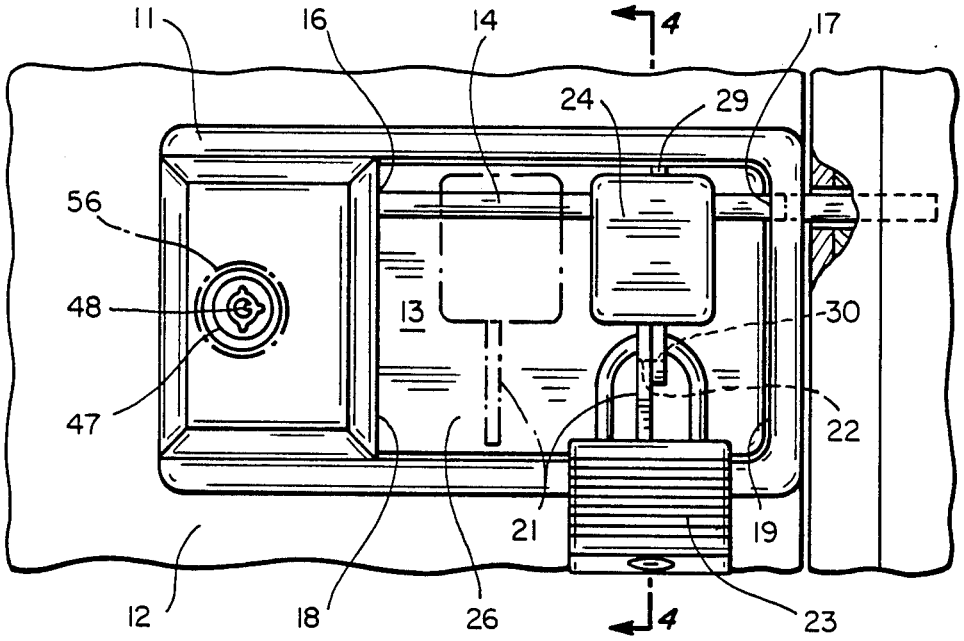
FIG. 1 is a front elevational view of one embodiment of a lock assembly according to the invention installed on a door.
Figure 2:
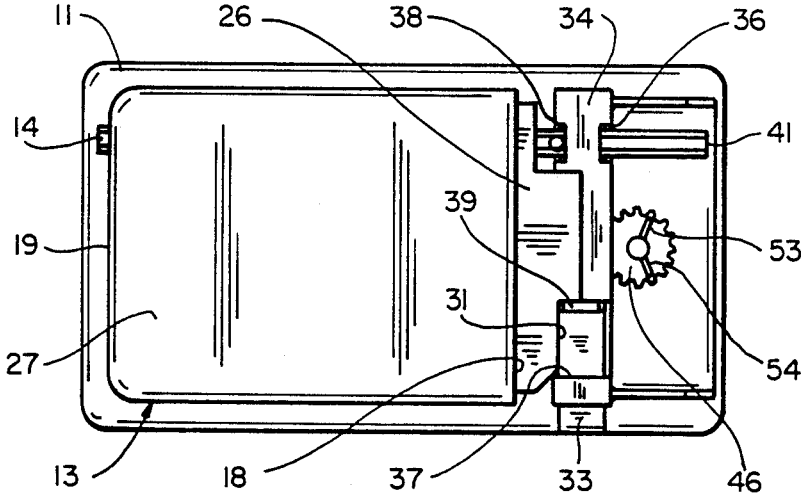
FIG. 2 is a rear elevational view of the embodiment of FIG. 1.
Figure 3:
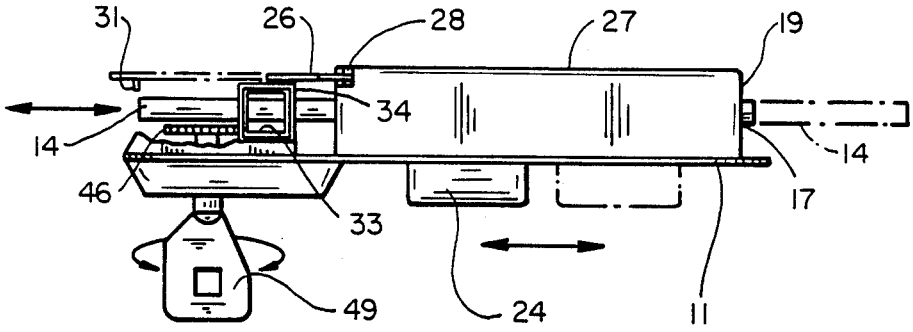
FIG. 3 is a top plan view of the embodiment of FIG. 1, with the lock bolt in its retracted position.
Figure 4:
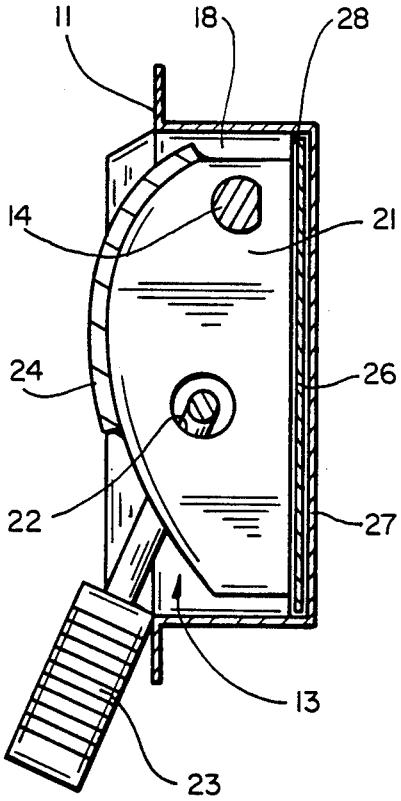
FIG. 4 is an enlarged cross-sectional view taken along line 4—4 in FIG. 1.

As illustrated in the drawings, the lock assembly includes a generally rectangular base plate 11 which is adapted to mounted on the outer or front side of a door such as the door 12. The base plate has a generally rectangular recessed area 13 which is received in an opening (not shown) in the door.

A lock bolt 14 is slidably mounted on the base plate for axial movement between extended and retracted positions. The bolt extends through the recessed area and passes through aligned guide openings 16, 17 in the side walls 18, 19 of the recessed area. The bolt and the guide openings have corresponding non-circular cross-sections which permit the bolt to move axially but not rotate. A flange 21 having an opening 22 for receiving the shackle of a padlock 23 is affixed to the bolt in the recessed area. In the embodiment illustrated, the bolt extends in a horizontal direction, and the flange extends vertically. A curved shield plate 24 is affixed to the upper portion of the flange to limit access to the shackle for greater security. In FIG. 1, the bolt is shown in the extended position in solid lines and in the retracted position in phantom lines.

A lock plate or slide plate 26 is slidably mounted on the base plate for movement in a direction generally parallel to the bolt. The lock plate is positioned between the bolt and the rear wall 27 of the recessed area, and it passes through a slot 28 in the side wall 18 of the recessed area. The slide plate has a forwardly projecting flange 29 with an opening 30 for receiving the shackle of the padlock whereby the bolt and the slide plate can be secured together. A flange 31 extends in a forward direction from the end of the slide plate outside the recessed area, and as discussed more fully hereinafter, is utilized to lock the slide plate in the normal position shown in FIG. 1.

Means is provided for selectively locking the slide plate in its normal position and the bolt in its extended position. This means includes a lock member 33 which is slidably mounted in a bracket 34 on the back side of base plate 11 outside the recessed area for movement in a direction perpendicular to the movement of bolt 14 and slide plate 26. In the embodiment illustrated, the slide comprises an elongated tubular member of generally square cross-section. Bracket 34 is affixed to the base plate and has an opening 36 aligned with lock bolt 14 and a notch 37 aligned with slide plate flange 31. Lock member 33 likewise has an opening 38 which can be aligned with opening 36 and lock bolt 14, and a notch 39 which can be aligned with notch 37 and flange 31.

When opening 38 is aligned with opening 36, the inner end portion 41 of lock bolt 14 can pass through the openings, and the lock bolt is thus free for movement to its retracted position. Similarly, when notch 39 is aligned with notch 37, flange 31 can pass through the notches, and the slide plate is thus free for movement from its normally locked position.

Figure 5:
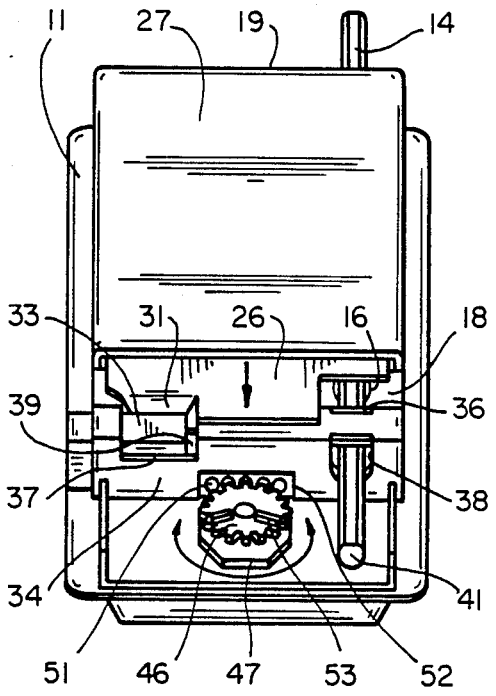
FIG. 5 is an oblique rear view of the embodiment of FIG. 1, rotated through an angle of 90° relative to FIG. 2.
Figure 6:
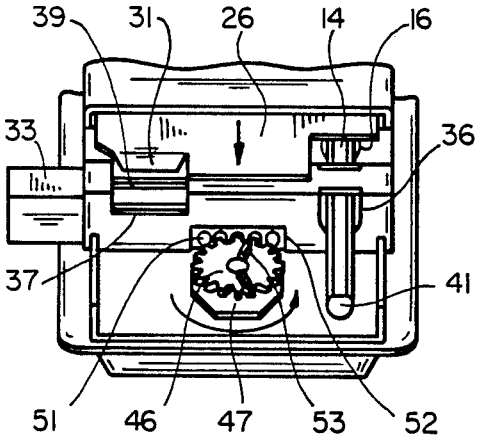
FIGS. 6 and 7 are fragmentary operational views, similar to FIG. 5, showing the lock mechanism in different positions.
Figure 7:
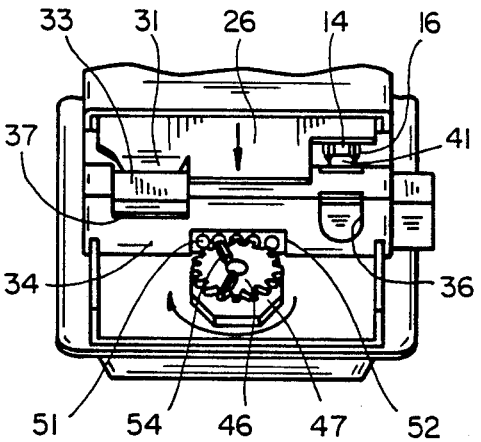

Lock member 33 is movable between three positions, as shown in FIGS. 5–7. In the first position, illustrated in FIG. 5, opening 38 is aligned with opening 36, but notch 39 is not aligned with notch 37. The lock member obstructs notch 37 so that flange 31 cannot pass through it, thereby locking the slide plate in its normal position. In the second position, illustrated in FIG. 6, notch 39 is aligned with notch 37, and the slide plate is free to move. In this position, lock member 33 is moved completely out of opening 36, and lock bolt 14 is free to pass through the opening. In the third position, illustrated in FIG. 7, neither the openings nor the notches are aligned, and neither the lock bolt nor the slide plate can be moved. The lock bolt is thus locked in its extended position.

Means is provided for selectively moving lock member 33 between its three positions. This means includes a cogwheel 46 mounted on the output shaft of a lock cylinder 47 mounted on base plate 11. The lock cylinder has a keyhole or socket 48 and the cogwheel is turned by rotation of a key 49 inserted into this socket. A row of drive holes 51 extends along one side of lock member 33, and the teeth of the cogwheel engage these holes through a slotted opening 52 in the side wall of bracket 34. Stops 53, 54 on the cogwheel abut against the side wall to limit the rotation of the cogwheel when the lock member is in its second and third positions.

A small name plate or button 56 is removably mounted on the front side of the base plate to conceal the presence of lock cylinder 47. The name plate has a rearwardly projecting mounting which is inserted into socket 48 to hold the name plate in position.

Operation and use of the lock assembly for securing a rental storage space is as follows. Lock member 33 is normally set by the owner to the position shown in FIG. 5 wherein slide plate 26 is locked in its normal position and lock bolt 14 is free to move between its extended and retracted position. The key is removed from the lock cylinder socket, and the cover plate is installed to conceal the lock. The renter can install a padlock on flanges 21, 29 to lock the bolt to the slide plate and thereby secure the bolt in its extended position. When the padlock is removed, the bolt is free to be retracted even though the slide plate is locked in position by lock member 33.

If the owner should require access to the space while the renter's padlock is in place, he can remove the cover plate and turn the lock cylinder with his key to move lock member 33 to the position illustrated in FIG. 6 in which notches 37, 39 are aligned and the lock member is clear of opening 36. With the lock member in this position, the owner can move the lock bolt, the slide plate and the padlock as a unit to the retracted position.

If the owner should need to lock the renter out of the space, he can do so by turning the lock cylinder with his key to move the lock member to the position illustrated in FIG. 7 in which opening 36 is obstructed by the lock member and the lock bolt is thus locked in its extended position. With the lock member in this position, the lock bolt cannot be retracted even though the renter may remove his padlock.

The invention has a number of important features and advantages. It allows one person to have normal access to a space and a second person to have access to the space and to be able to lock the first person out of it. Such access or lockout is achieved with a single key-operated lock which is readily operated from the front side of the door. Additional security is provided by concealing the key-operated lock from view with a removable cover plate which mounts in the keyhole or socket.

It is apparent from the foregoing that a new and improved lock assembly has been provided. While only one presently preferred embodiment has been described in detail, as will be apparent to those familiar with the art, certain changes and modifications can be made without departing from the scope of the invention as defined by the following claims.

I claim:

1. In a lock assembly which allows a first person normally to have access to a space and allows a second person to enter the space and to lock the first person out of the space and allows a second of the space: a bolt movable between extended and retracted positions, a slide movable with the bolt, first lock means controlled by the first person for securing the bolt to the slide when engaged, and second lock means controlled by the second person and movable between a first position in which the slide is held in a fixed position and the bolt is free to move between the extended and retracted positions unless the first lock means is engaged, a second position in which the slide is free to move and the bolt can be moved between the extended and retracted positions even if the first lock means is engaged, and a third position in which the bolt is locked in the extended position and cannot be moved to the retracted position even if the first lock means is disengaged.

2. The lock assembly of claim 1 wherein the first lock means comprises a padlock.

3. The lock assembly of claim 1 wherein the second lock means comprises a lock member movable in a direction generally perpendicular to the bolt and the slide for selectively permitting and preventing movement of the bolt and the slide in the three positions.

4. The lock assembly of claim 3 wherein the second lock means includes a removable key and means for moving the lock member between the three positions upon rotation of the key.

5. The lock assembly of claim 4 wherein the lock member is lineally movable between the three positions, and the means for moving the lock member comprises a cogwheel in driving engagement with the lock member.

6. The lock assembly of claim 4 including a socket for receiving the key, and means removably mounted in the socket for concealing the presence of the second lock means.

7. In a lock assembly: a base, a bolt mounted on the base for movement between extended and retracted positions, a lock plate slidably mounted on the base for movement with the bolt, a removable padlock for securing the bolt to the lock plate, a lock member slidably mounted on the base for movement between a first position in which the lock member holds the lock plate in a fixed position, a second position in which the lock plate is free to move and a third position in which the lock member holds the bolt in the extended position, a lock cylinder mounted on the base with a socket for receiving a key, and cogwheel connected to the lock cylinder and in driving engagement with the lock member for moving the lock member between the three positions upon rotation of the key.

8. The lock assembly of claim 7 including a cover plate removably mounted in the key socket for concealing the presence of the lock cylinder.

* * * * *